US006253392B1

(12) United States Patent
Conforti et al.

(10) Patent No.: US 6,253,392 B1
(45) **Date of Patent: *Jul. 3, 2001**

(54) BATHTUB-BATHSEAT

(75) Inventors: Carl J. Conforti, Tiverton, RI (US); Scott A. Johnstone, Pleasant Valley; Glen Nielsen, Kent, both of CT (US)

(73) Assignee: The First Years Inc., Lake Forest, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/359,943

(22) Filed: Jul. 22, 1999

Related U.S. Application Data

(63) Continuation-in-part of application No. 09/120,934, filed on Jul. 22, 1998.

(51) Int. Cl.[7] ..... A47K 3/024
(52) U.S. Cl. ..... 4/572.1
(58) Field of Search ..... 4/572.1, 573.1, 4/578.1, 579, 659

(56) References Cited

U.S. PATENT DOCUMENTS

| | | |
|---|---|---|
| D. 241,250 | 8/1976 | Forte et al. . |
| D. 245,861 | 9/1977 | Elder . |
| D. 289,465 | 4/1987 | Wise . |
| 2,324,421 | 7/1943 | Ouelette . |
| 3,031,229 | 4/1962 | Symbaluk . |
| 3,272,556 | 9/1966 | Rocker . |
| 3,290,092 | 12/1966 | Howard . |
| 3,463,504 | 8/1969 | Petry et al. . |
| 3,976,328 | 8/1976 | Stahel . |
| 3,995,331 | 12/1976 | Fotre et al. . |
| 4,371,206 | 2/1983 | Johnson, Jr. . |
| 4,634,175 | 1/1987 | Wise . |
| 4,986,599 | 1/1991 | Wise . |
| 5,010,606 | 4/1991 | Bernstein et al. . |
| 5,011,221 | 4/1991 | Wise . |
| 5,143,419 | 9/1992 | Tepper et al. . |
| 5,244,292 | 9/1993 | Wise . |
| 5,276,926 | 1/1994 | Lopez . |
| 5,317,765 | 6/1994 | Knoedler et al. . |
| 5,321,859 | 6/1994 | Buckshaw et al. . |
| 5,464,381 | 11/1995 | Wilson . |
| 5,533,786 | 7/1996 | Cone, II . |
| 5,542,587 | 8/1996 | Broz et al. . |
| 5,588,158 | 12/1996 | Poulson et al. . |

*Primary Examiner*—Robert M. Fetsuga
(74) *Attorney, Agent, or Firm*—Fish & Richardson, P.C.

(57) ABSTRACT

A tub defines a volume for receiving a child and holding water in a top side at least when oriented in a reclined position, the tub having a back side, head and foot ends, and first and second arms connected by a front cross member. The first and second arms are pivotally attached to the tub about an axis displaced from the foot end of the tub into at least first and second positions. The front cross member is disposed above, and displaced from, the top side of the tub when the arms are in first position. An elongated member is attached to the front cross member at a first end and extends from the front cross member to a second end having a foot disposed below the foot end of the tub and adapted to engage a smooth surface. The elongated member extends toward the foot end of the tub to provide a passive crotch restraint for a child received by the tub when the arms are in first position.

26 Claims, 10 Drawing Sheets

BATHTUB-BATHSEAT

RELATED APPLICATION

This application is a continuation-in-part of U.S. patent application Ser. No. 09/120,934, filed Jul. 22, 1998, entitled "Bathtub-Bathseat", which is hereby incorporated fully by reference.

BACKGROUND OF THE INVENTION

The invention relates to a bathtub and bathseat combination and in particular to an apparatus for use interchangeably in a bathtub configuration and a bathseat configuration.

Children's bathtubs allow persons to bathe a child in a manner in which the child is safe and comfortable. These bathtubs are typically adapted to fit within an adult-sized bathtub, or even a sink. Persons can place the children's bathtub into the adult bathtub or the sink, fill the children's bathtub with water, put the child into the children's bathtub, and bathe the child.

Bathseats can also be used to bathe the child, with the child positioned in a seated, upright position. Typically, these seats are used for children that are at least a few months old and have enough neck strength to support their heads.

SUMMARY OF THE INVENTION

In general, in one aspect, the invention features an apparatus including a tub adapted to receive a child and to hold water in a top side at least when oriented in a reclined position, the tub having a back side, a head end, and a foot end, a first arm portion and a second arm portion connected by a front cross member, the first and second arm portions each being pivotally attached to the tub about an axis displaced from the foot end of the tub into at least first and second positions, the front cross member being disposed above, and displaced from, the top side of the tub when the arm portions are in the first position, and an elongated member attached to the front cross member at a first end and extending from the front cross member to a second end having a foot disposed below the foot end of the tub and adapted to engage a smooth surface, the elongated member extending toward the foot end of the tub to provide a passive crotch restraint for a child received by the tub when the arm portions are in the first position.

Implementations of the invention may include one or more of the following features. The apparatus can further comprise a third arm portion connected to the first arm portion and a fourth arm portion connected to the second arm portion, the third and fourth arm portions extending from the first and second arm portions behind the back side of the tub and toward the head end of the tub when the first and second arm portions are in the second position. The apparatus can further comprise a rear cross member connecting the third and fourth arm portions to form a rear support. The rear support can include a pair of feet adapted to engage the bathtub floor. The front cross member can be disposed adjacent to the top side of the tub near the foot end when the first and second arm portions are in the second position. The tub can define a hole near the foot end for slidably receiving the elongated member. The apparatus can further comprise a coupling adapted to secure the first arm portion to the tub when the first arm portion is in the second position to prevent rotation of the first arm portion toward the first position when a torque less than a predetermined torque is applied to the first arm portion relative to the tub.

The coupling can be further adapted to substantially prevent rotation of the first arm portion when the first arm portion is in the first position. The tub, the arm portions, and the elongated member can be arranged to be received by a kitchen sink or an adult-sized bathtub.

In general, in another aspect, the invention features an apparatus adapted to receive a child and to be pivoted between a bathtub position and a bathseat position, the apparatus including a tub having a front side and a rear side, the front side adapted to receive a child and to hold water, the tub further having a head end and a foot end and defining an opening near the foot end, a support including a pair of arm portions, a first cross member, and a second cross member, each arm portion being selectively pivotally coupled to the tub to a bathtub position and a bathseat position, the first cross member connecting arm portions above the front side of the tub when the arm portions are in the bathseat position, the second cross member connecting the arm portions behind the rear side of the tub in both the bathtub and bathseat positions, the support including a pair of feet disposed behind the rear side of the tub and adapted to be mounted to a smooth surface, and a leg depending from the first cross member and configured to be slidably received by the hole in the tub, the leg including a foot displaced from the first cross member and adapted to be mounted to the smooth surface, wherein feet of the support and the foot of the leg are adapted to be received by a kitchen sink.

In general, in another aspect, the invention features an infant bathseat including a tub having a bottom surface and raised side, head and foot portions defining a volume for containing water when the tub is in a reclining position with the head and foot portions positioned above the bottom surface, an arm portion on each side of the tub extending toward the foot portion and extending below the tub adjacent the, each arm portion being pivotally connected to the tub between the foot and the head portions, whereby on rotation of the arm portions away from the tub, the tub is raised from a reclining to a seating position with the head portion elevated above the foot portion, a cross member connecting the arm portions near the foot portion, and a support member extending vertically downward from the cross member and with the tub in a seating position forming a passive restraint for a child when seated in the bathseat.

Implementations of the invention may include one or more of the following features. The arm portions can be disposed above the foot portion when the tub is in the seating position. The arm portion can be fixedly attached to a shaft having a generally dumbbell shape, and the tub can include a hub defining a slot in communication with a circular hole, the hole being adapted to rotatably receive the shaft, the slot being adapted to slidably receive the shaft when the length of the dumbbell shape is directed along the length of the shaft. The arms and the cross member are integrally connected.

Embodiments of the invention may provide one or more of the following advantages. A single apparatus can be used as both a bathtub and a bathseat. Accidental movement of an apparatus from a bathseat configuration to a bathtub configuration can be inhibited. An arm portion of a combined bathtub-bathseat can be selectively pivoted and locked. A single apparatus can adapt to changing needs of the child and the child's parents as the child grows. An apparatus can be stably mounted or attached to a bathtub. Other advantages will become apparent from the following description and from the claims.

DESCRIPTION OF PREFERRED EMBODIMENTS

The invention provides an apparatus that can be used as a bathtub for bathing an infant and converted for use as a bathseat for bathing a child. The apparatus can be locked into the bathseat configuration to help guard against the apparatus accidentally shifting from the bathseat configuration to the bathtub configuration. The apparatus can be securely attached or mounted to the floor or hubs 55 of an adult-sized bathtub or attached or mounted at least partially within a sink.

Figure 1:
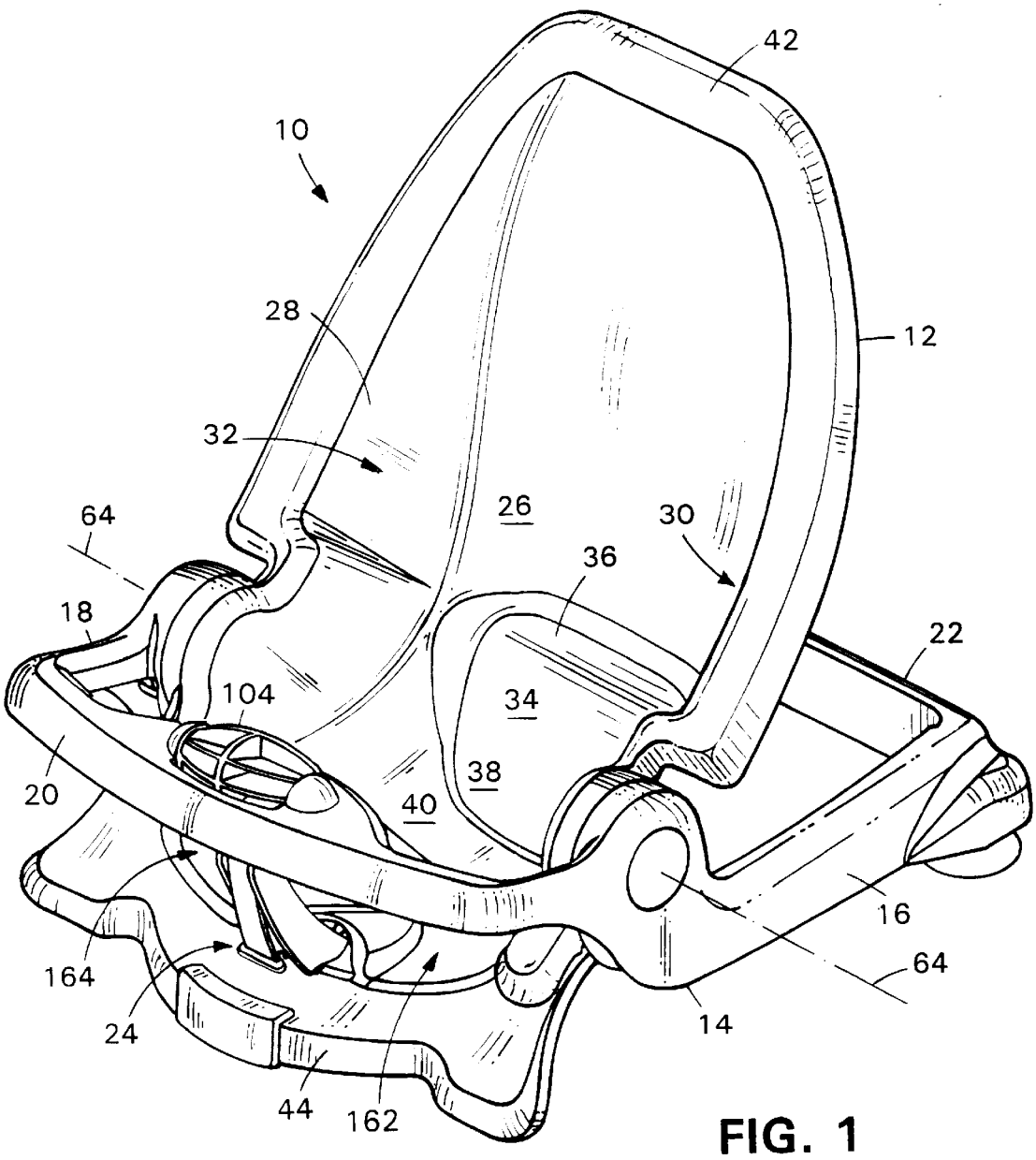
FIG. 1 is a perspective view of a bathtub-bathseat, in a bathseat position.
Figure 2:
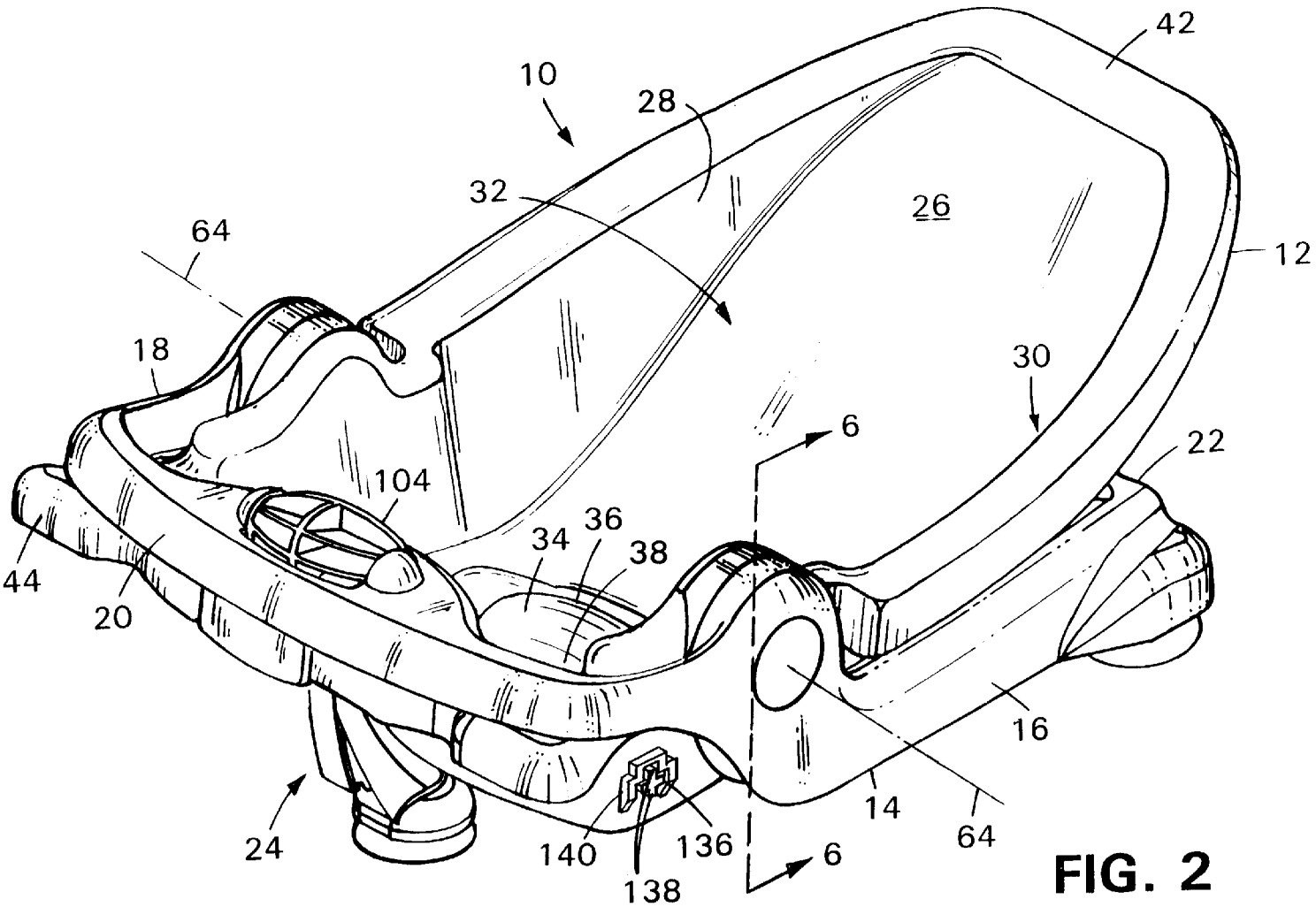
FIG. 2 is a perspective view of the bathtub-bathseat, shown in FIG. 1, in a reclining bathtub position.

As shown in FIGS. 1–2, a bathtub-bathseat assembly 10 includes a tub or basin 12, a substantially rectangular (see FIG. 3) arm 14 including two sides 16 and 18 connected by cross members 20 and 22, and a front support 24. Assembly 10 can be positioned in either the bathseat position, shown in FIG. 1, or the bathtub position, shown in FIG. 2. Assembly 10 is configured to be placed in a sink or placed within an adult-sized bathtub and mounted to the floor of the adult-sized bathtub. Rounded edges and corners of assembly 10 help prevent injury.

Tub 12 has a bottom wall 26 and side walls 28 and 30 (see FIG. 4) that provide a volume 32. Volume 32 is configured for receiving a child. Bottom wall 26 is contoured to accommodate a child and includes a bottom/back rest 34. Rest 34 includes a top portion 36 adapted so that an infant can sit on top portion 36. Rest 34 also includes a front portion 38 adapted to provide back support to a child sitting on a surface region 40 (not shown in FIG. 2) of bottom wall 26. Bottom wall 26 is integrally connected to side walls 28 and 30 such that tub 12 is adapted to hold water in volume 32, especially when in the bathtub position. A drainage hole 33 is provided through bottom wall 26 (FIG. 3).

Figure 3:
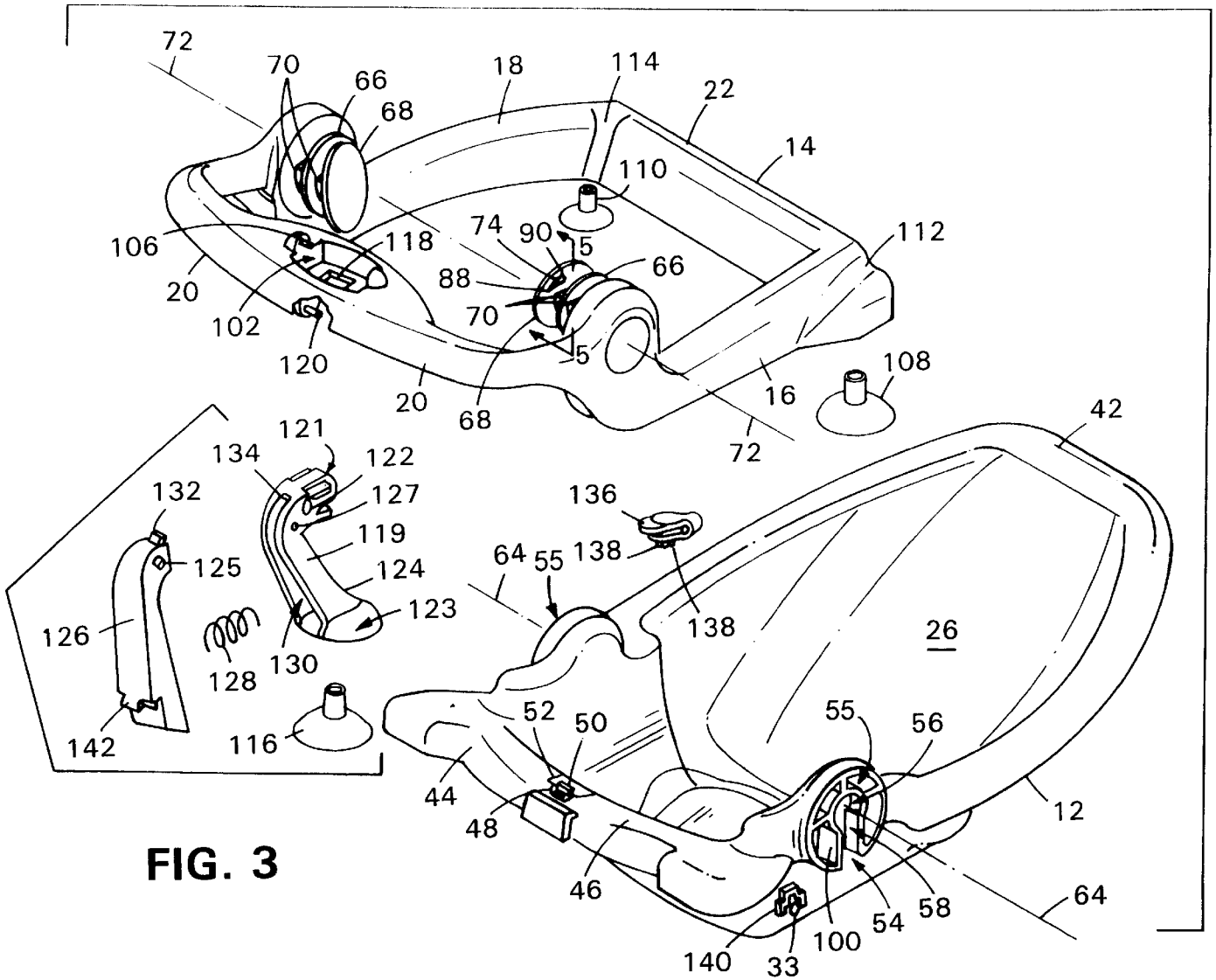
FIG. 3 is a perspective exploded view of the bathtub-bathseat shown in FIGS. 1–2.

Referring to FIG. 3, tub 12 has a head end 42 and a foot end 44. At foot end 42, a ledge 46 provides a recess 48 and includes an upwardly directed tab 50. Ledge 46 and a foot end portion of bottom wall 26 also provide a hole 52 through ledge 46 and bottom wall 26.

Figure 4:
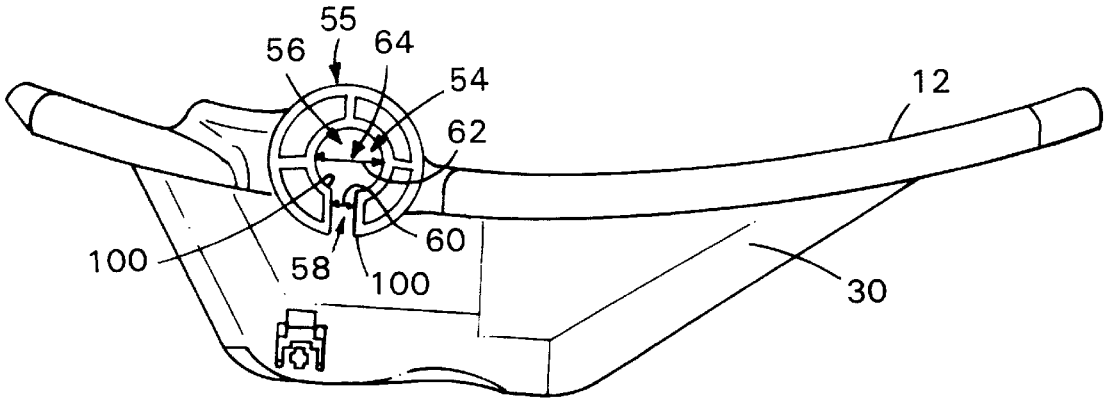
FIG. 4 is a plan view of the left side of a tub of the bathtub-bathseat shown in FIGS. 1–2.

Referring also to FIG. 4, tub 12 provides key holes 54 (only one is shown in FIG. 4) in exterior portions of each side of tub 12. Key holes 54 do not extend through side walls 28 and 30 of tub 12. Each key hole 54 has an upper circular hole 56, centered along an axis 64, and a lower slot 58 in fluid communication with hole 56. As shown in FIG. 4, slot 58 has a width 60 relatively smaller than a diameter 62 of hole 56. Key holes 54 are located along the sides of tub 12 closer to foot end 44 than to head end 42.

Figure 5:
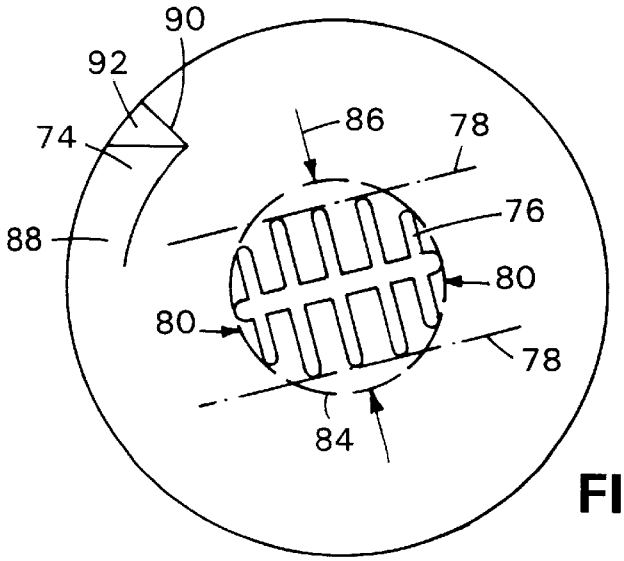
FIG. 5 is a cross-sectional view of a rod shown schematically in FIG. 3, as indicated by a line 5—5 in FIG. 3.

Arm 14 includes two sets of discs 66 and 68 integrally connected by shafts 70 (schematically shown in FIG. 3) that are adapted to be received by key holes 54. Discs 66 and 68 and shafts 70 are centered on an axis 72. Shafts 70 are configured to be slidingly received by slots 58 of key holes 54 in tub 12 and to be rotatingly received within holes 56 in key holes 54. As shown in FIG. 5, shaft 70 includes a plurality of ribs 76 arranged to effectively provide two flat sides indicated by lines 78 and two rounded ends 80. Flat sides 78 are separated by a distance 82 approximately equal to, but slightly smaller than width 60 of slot 58 in tub 12. Rounded ends 80 effectively provide the curvature of a circle 84 having a diameter 86 approximately equal to, but slightly less than, diameter 62 of hole 56 in tub 12 and larger than width 60 of slot 58. Shafts 70 are schematically shown as rectangles with rounded ends in FIGS. 3, 7–8, and 10.

Referring to FIGS. 3 and 5, a ramp surface 74 is disposed adjacent the periphery of each disc 68. Ramp 74 has a thin end 88 and a thick end 90, with a flat top portion 92.

Returning to FIGS. 1–2, arm 14 is pivotally connected to tub 12 for movement about axis 64.

Figure 6:
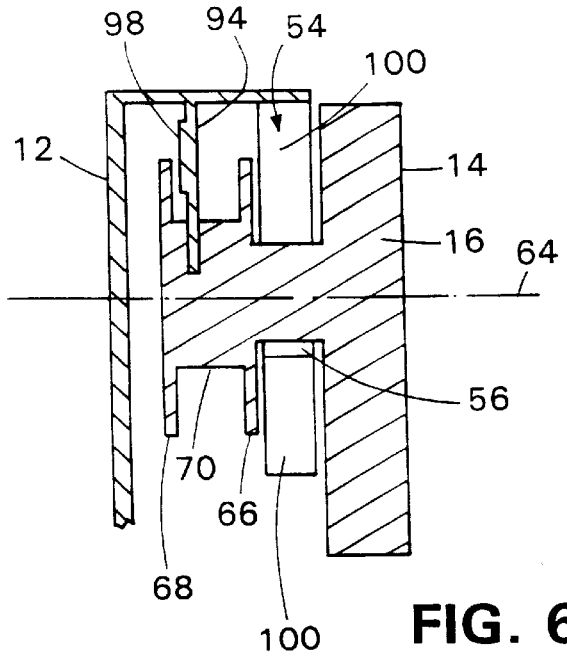
FIG. 6 is a schematic cross-sectional view of a portion of an arm and a portion of the tub shown in FIG. 2 as indicated by a line 6—6 in FIG. 2.
Figure 6A:
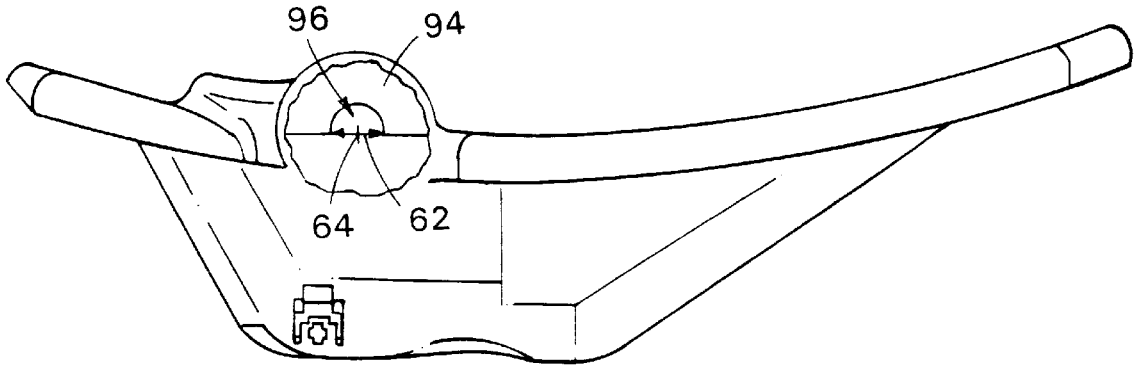
FIG. 6A is a plan view of the left side of a tub of the bathtub-bathseat shown in FIGS. 1–2 with a portion of the tub removed to shown a vane of the tub.

Referring to FIGS. 6 and 6A, tub 12 includes vanes 94 (only one shown) forming part of key holes 54 (FIGS. 3–4). As shown in FIG. 6A (partially cut away with the portion of tub 12 shown in FIGS. 3–4 forming part of key holes 54 removed), vane 94 has a semicircular cutout 96 of the same diameter 62 as hole 56 (FIG. 4) and is centered along axis 64. FIG. 6 shows the relationship of discs 66 and 68, and shaft 70 of arm 14, to tub 12. As shown, side 16 of arm 14 is disposed adjacent to tub 12 and, in particular, to a wall 100 (see also FIGS. 3–4) of tub 12 forming part of key hole 54. Disc 66 is disposed adjacent to an opposite side of wall 100 from side 16. Vane 94 is disposed between discs 66 and 68. Shaft 70 extends through hole 56 and cutout 96 (FIG. 6A). Vane 94 has a rib 98 disposed and configured to interfere with ramp 74 (FIGS. 3 and 5) when arm 14 is pivoted about axis 64.

Referring to FIGS. 1–3, arm 14 is shaped and connected to tub 12 such that cross member 20 is disposed in front of tub 12 and cross member 22 is disposed behind tub 12. Side 16 has a somewhat "Z" shape when viewed from the left side of assembly 10 and side 18 has a somewhat "S" shape when viewed from the right side of assembly 10. Cross member 20 includes posts 106 (only one is shown in FIG. 3) in a trough 102 for receiving a toy 104 (FIGS. 1–2). A hole 118 is provided in the bottom of trough 102 to allow liquid to drain.

Forward of hole 118, shown in FIG. 3 with a portion of cross member 20 cut away, are two posts 120 (only one of which is (schematically) shown).

Referring to FIG. 3, front support 24 includes a base 124 and a lever 126. Two holes 122 (only one shown in FIG. 3) in base 124 are sized to pivotally receive posts 120 of arm 14. Lever 126 includes two posts 125 (only one (schematically) shown in FIG. 3) adapted to be received by holes 127 in base 124. Lever 126 has a top end 121 and a middle section 119 that are configured to be inserted through hole 52 in tub 12 and a bottom end 123 that is larger than hole 52. Lever 126 is coupled to base 124 by a spring 128 and is pivotally received about holes 127 in an opening 130 in base 124. Spring 128 is received by a tube (not shown) inside opening 130 of base 124 and receives a rod (not shown) extending from lever 126. Spring 128 biases lever 126 to rotate about the center axis of holes 127. Lever 126 includes an upwardly-extending tab 132 to interfere with an end wall 134 of opening 130 in base 124. Lever 126 also includes a downwardly-extending tab 142 configured to be received by recess 48 in cross member 20 of tub 12. Tab 142 extends downwardly further than tab 50 of tub 12 extends upwardly plus the depth of recess 48.

Suction cups are attached to the bottoms of arm 14 and front support 24 for attaching to the floor of an adult-sized bathtub. Two suction cups 108 and 110 are mounted to the bottoms of junction 112 and 114 between cross member 22 and sides 16 and 18, respectively. A suction cup 116 is mounted to the bottom of base 124. The locations of the suction cups 108, 110, and 116, as shown, provides stability to assembly 10 when, e.g., mounted, attached, or rested on a surface such as a bathtub floor.

A plug 136 is received by drainage hole 33. Tabs 138 interfere with a bracket 140 (see also FIG. 2) on the bottom of tub 12 to inhibit rotation of plug 136 when received by hole 33.

Figure 8:
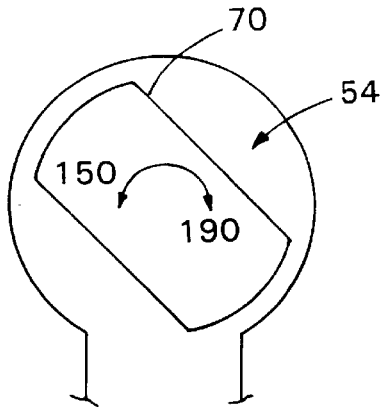
FIG. 8 is a schematic cross-sectional view of a rod in a key-hole for the bathtub-bathseat in the position shown in FIG. 1.
Figure 10:
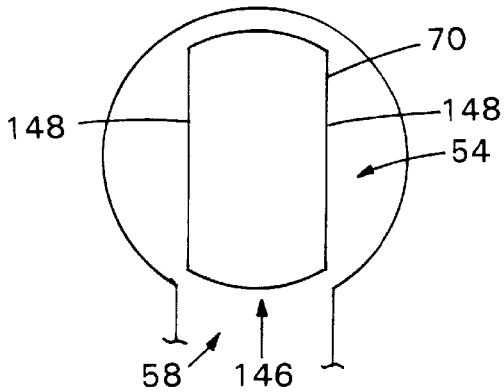
FIG. 10 is a schematic cross-sectional view of a rod in a key-hole for the bathtub-bathseat in an assembly position shown in FIG. 9.
Figure 9:
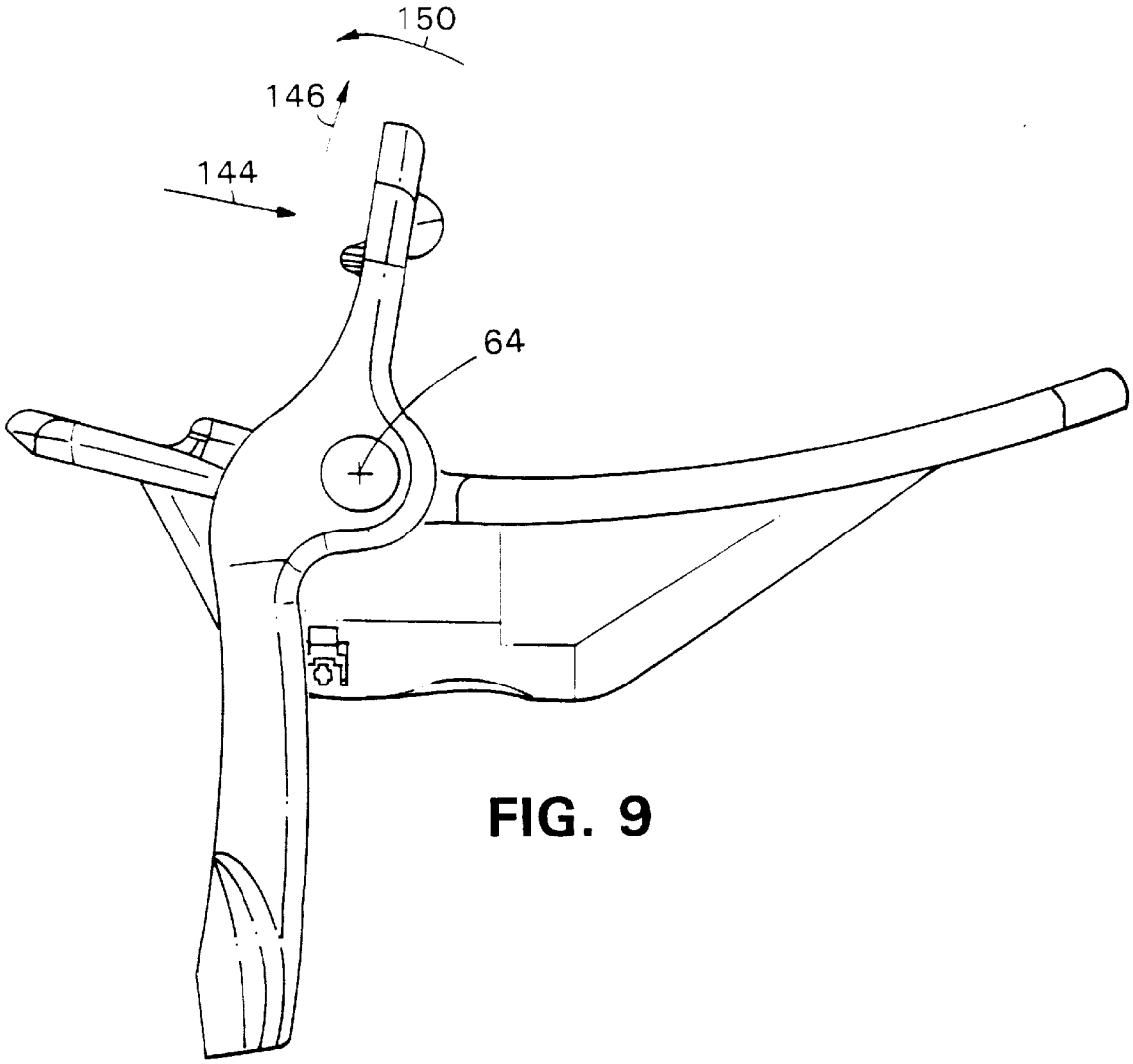
FIG. 9 is a left side view of the bathtub-bathseat, shown in FIG. 1, in an assembly position.

Assembly 10 is assembled as follows. Front support 24 is assembled by placing spring 128 in the tube inside base 124 and inserting lever 126 into opening 130. Lever 126 is inserted such that posts 125 are received by holes 127 and spring 128 is received by the rod extending from lever 126. Suction cup 116 is attached to the bottom of base 124. Suction cups 108 and 110 are attached to the bottoms of junctions 112 and 114 of arm 14. The top of support 24 is inserted through hole 52 in tub 12 and base 124 coupled to arm 14 with holes 122 of base 124 receiving posts 120 of arm 14. As shown in FIG. 9, arm 14 is rotated substantially perpendicular to tub 12 and slid over tub 12 as indicated by arrow 144 and up as indicated by arrow 146 such that shafts 70 have their flat edges 148 aligned parallel to the walls of slots 58, allowing key holes 54 to receive shafts 70 as shown in FIG. 10. Axis 72 of arm 14 thus is substantially aligned with axis 64 of holes 56. Arm 14 is rotated as indicated by arrow 150 in FIG. 8 toward the bathseat position shown in FIG. 1, with shaft 70 rotating to its bathseat position as shown in FIG. 8. Ramp 74 (FIGS. 3 and 5) ramps over rib 94 on disc 68. Thick end 90 of ramp 74 inhibits rotation in a direction 190 opposite to direction 150, thus inhibiting edges 148 of shafts 70 from realigning with slots 58. Arm 14 is thus inhibited from being removed from tub 12. Toy 104 is inserted into trough 102 with toy 104 being received by posts 106. Plug 136 is inserted into drainage hole 33.

In operation, assembly 10 can be positioned and used interchangeably in a bathseat configuration (FIG. 1) and a bathtub configuration (FIG. 2).

Figure 11:
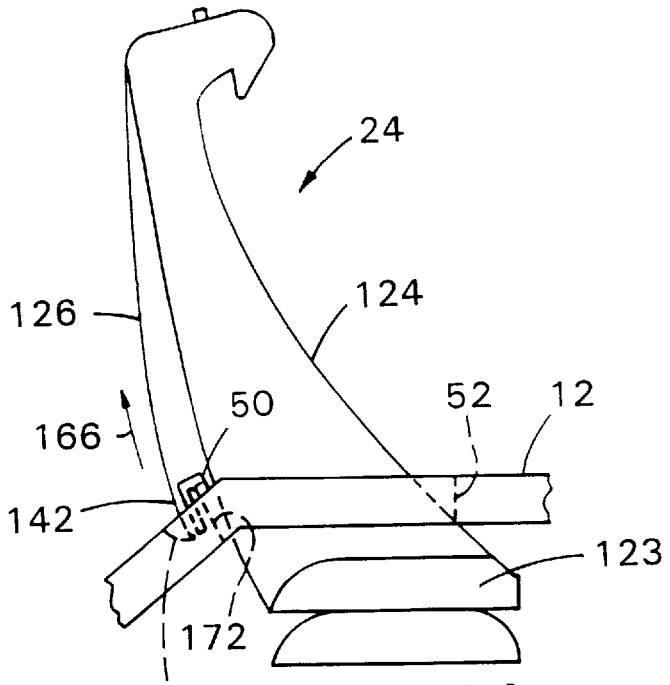
FIG. 11 is a schematic side view of a support and a portion of the tub of the bathtub-bathseat in the bathseat position.

With assembly 10 in the bathseat position, shaft 70 is in the position shown in FIG. 8, and front support 24 is in the position shown in FIG. 11 (arm 14 not shown in FIG. 11). Front support 24 extends downwardly from cross member 20 through hole 52 of tub 12 to provide a passive crotch restraint for a child seated in volume 32 provided by tub 12. As shown in FIG. 11, bottom end 123 of support 24 is not inserted up through hole 52 in tub 12, bottom end 123 being unable to fit through hole 123. This helps prevent arm 14 from being rotated such that edges 148 of shafts 70 realign with slots 58, thus inhibiting disassembly of arm 14 from tub 12. Downwardly-extending tab 142 is received by recess 48 in tub 12. Cross members 20 and 22 are separated from tub 12.

Figure 13:
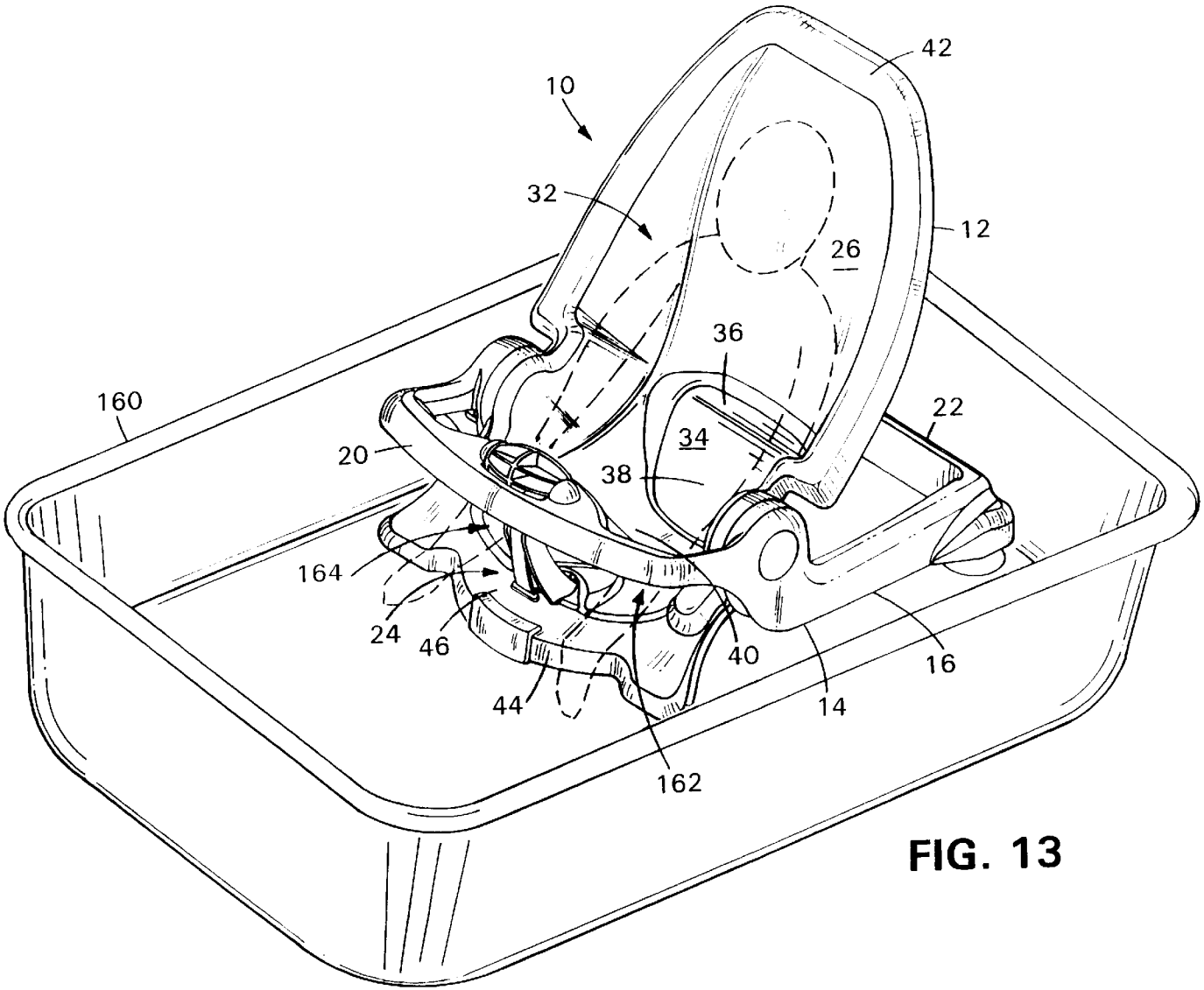
FIG. 13 is a perspective view of the bathtub-bathseat shown in FIG. 1 mounted in an adult-sized bathtub.

In the bathseat position, as shown in FIG. 13, assembly 10 can be mounted in an adult-sized bathtub 160 (shown schematically and out of scale). Suction cups 108, 110, and 116 (FIG. 3) removably connect assembly 10 to the floor of the tub 160, with sides 16 and 18 (not shown in FIG. 11) and cross member 22 providing support to assembly 10. The tub 160 can be filled with water and a child placed in volume 32 as shown. The child sits on region 40 with the child's lower back resting against front portion 38 of rest 34 and the child's legs extending through openings 162 and 164 (FIG. 1) between front support 24, cross member 20, ledge 46 of tub 12, and sides of the tub 12. Front support 24 serves as a passive crotch restraint in this position.

Figure 12:
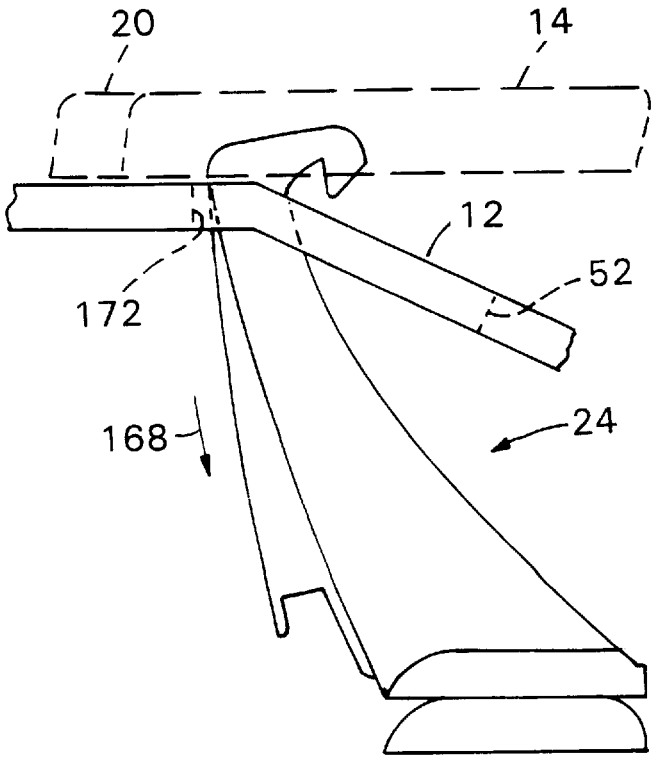
FIG. 12 is a schematic side view of a support and a portion of the tub of the bathtub-bathseat in the bathtub position.

Assembly 10 can be repositioned from the bathseat position to the bathtub position. The child in volume 32 should be removed, and water in volume 32 drained by opening plug 136. Referring to FIGS. 1 and 11, cross member 20 is separated from tub 12, lifting tab 142 from recess 48 as indicated by arrow 166 in FIG. 11. (The weight of a child in volume 32 will inhibit separating cross member 20 from tub 12.) Front support 24 is squeezed to push lever 126 into opening 130. Tabs 142 and 50 and a wall of recess 48 inhibit lever 126 from being pushed into opening 130 unless front support 24 is moved upward in direction 166 to remove tab 142 from recess 48. Cross member 20 is brought close to ledge 46, such that support 24 moves through hole 52 in tub 12 in direction 168 shown in FIG. 12, until arm 14 (shown schematically in FIG. 12) interferes with tub 12. Shaft 70 rotates in direction 150 until it reaches its bathtub position shown in FIG. 7.

Figure 14:
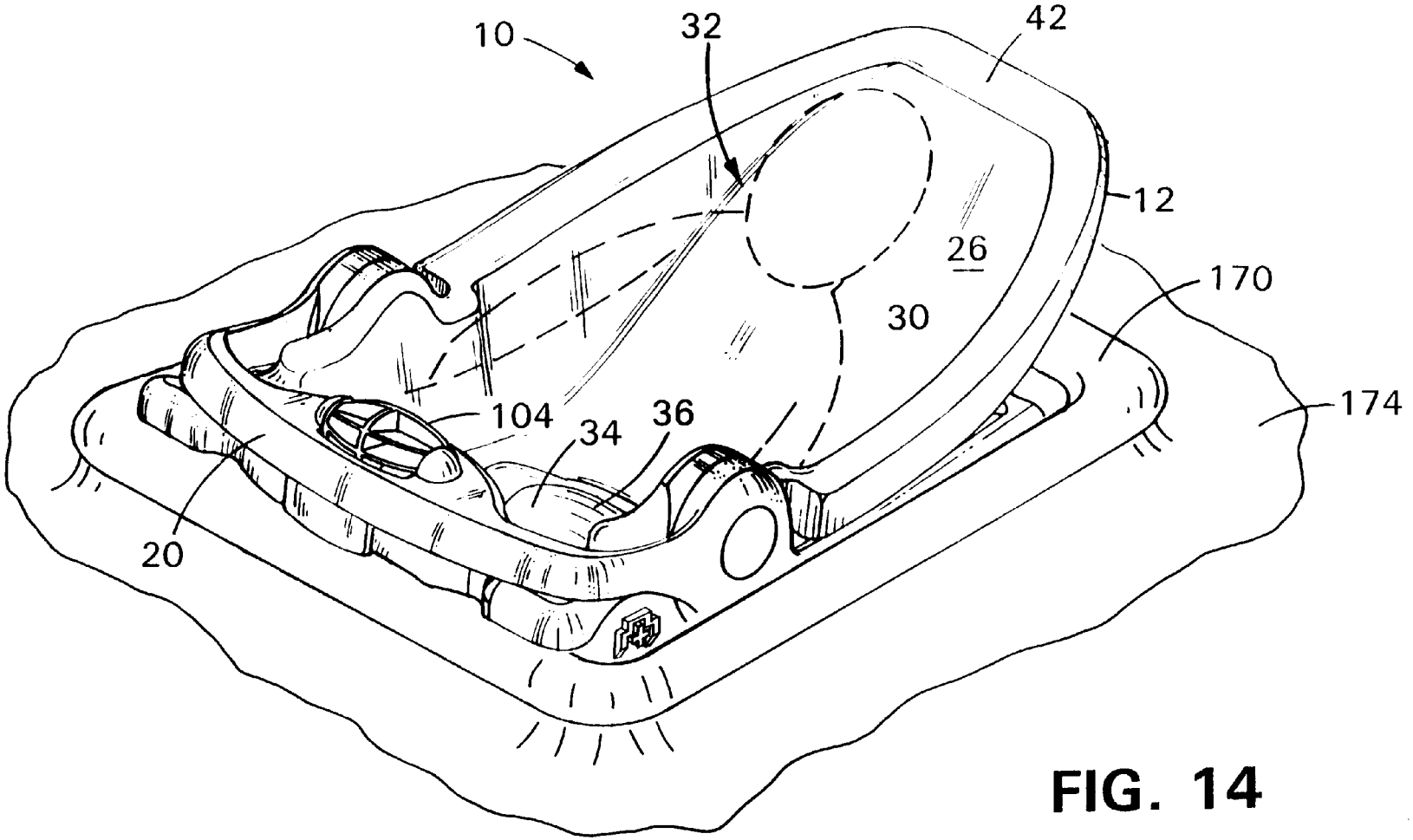
FIG. 14 is a side view of the bathtub-bathseat shown in FIG. 2 mounted in a sink.

In the bathtub position, as shown in FIG. 14, assembly 10 can be mounted in a sink 170 (e.g., disposed in a counter 174). Tub 12 can be filled with water and an infant placed in volume 32 as shown with substantially the infant's entire body, including legs, being received by volume 32. The infant sits on top portion 36 and uses the portion of bottom 26 between top portion 36 and head end 42 as a back rest. In the bathtub position, cross member 20 is adjacent foot end 44 of tub 12 and cross member 22 is closer to head end 42 of tub 12 than when in the bathseat position (FIG. 1).

Figure 7:
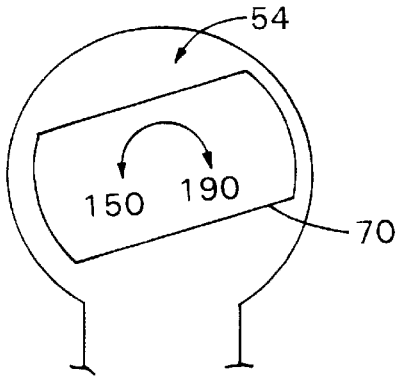
FIG. 7 is a schematic cross-sectional view of a rod in a key-hole for the bathtub-bathseat in the position shown in FIG. 2.

To move assembly 10 from the bathtub position to the bathseat position, cross member 20 is separated from tub 12. The infant should be removed, and the water drained by opening plug 136. Separating cross member 20 from tub 12 causes shaft 70 to rotate in direction 190 as indicated in FIG. 7 and causes lever 126 to rub against a wall 172 (FIG. 12) of hole 52, causing lever 126 to be pushed into opening 130. When tab 142 is disposed higher than tab 50, spring 128 pushes lever 126 away from base 124. Tab 132 on lever 126 hits wall 134 and stops pivoting of lever 126. Support 24 is lowered such that tab 142 is received by recess 28. Shaft 70 is again in its bathseat position shown in FIG. 8.

Figure 15:
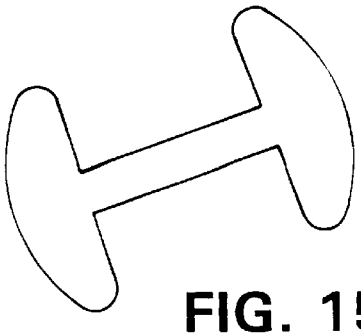
FIG. 15 is a schematic cross-sectional view of an alternative shape of a rod of the bathtub-bathseat shown in FIGS. 1–2.

Other embodiments are within the scope of the following claims. For example, a dumbbell-shaped shaft 180 shown in FIG. 15 can be used instead of shaft 70. Hole 56 can rotatably receive shaft 180 if the length of the shaft 180 is aligned with the length of slot 58.

What is claimed is:

1. An apparatus comprising:

a tub defining a volume for receiving a child and holding water in a top side at least when oriented in a reclined position, the tub having a back side, a head end, and a foot end;

a first arm and a second arm connected by a front cross member, the first and second arms each being pivotally attached to the tub about an axis displaced from the foot end of the tub into at least first and second positions, the front cross member being disposed above, and displaced from, the top side of the tub when the arms are in the first position; and an elongated member attached to the front cross member at a first end and extending from the front cross member to a second end having a foot disposed below the foot end of the tub and adapted to engage a smooth surface, the elongated member extending toward the foot end of the tub to provide a passive crotch restraint for a child received by the tub when the arms are in the first position.

2. The apparatus of claim 1 further comprising a third arm connected to the first arm and a fourth arm connected to the second arm, the third and fourth arms extending from the first and second arms behind the back side of the tub and toward the head end of the tub when the first and second arms are in the second position.

3. The apparatus of claim 2 further comprising a rear cross member connecting the third and fourth arms to form a rear support.

4. The apparatus of claim 3 wherein the rear support includes a pair of feet adapted to engage a smooth surface.

5. The apparatus of claim 1 wherein the front cross member is disposed adjacent to the top side of the tub near the foot end when the first and second arms are in the second position.

6. The apparatus of claim 1 wherein the tub defines a hole near the foot end for slidably receiving the elongated member.

7. The apparatus of claim 1 further comprising a coupling adapted to secure the first arm to the tub when the first arm is in the second position to prevent rotation of the first arm toward the first position when a torque less than a predetermined torque is applied to the first arm relative to the tub.

8. The apparatus of claim 7 wherein the coupling is further adapted to substantially prevent rotation of the first arm when the first arm is in the first position.

9. The apparatus of claim 1 wherein the tub, the arms, and the elongated member are arranged to be received by a kitchen sink or an adult-sized bathtub.

10. An apparatus adapted to receive a child and to be pivoted between a bathtub position and a bathseat position, the apparatus comprising:

a tub having a front side and a rear side, the front side defining a volume for receiving a child and holding water, the tub further having a head end and a foot end and defining an opening near the foot end;

a support including a pair of arms, a first cross member, and a second cross member, each arm being pivotally coupled to the tub for movement into a bathtub position and into a bathseat position, the first cross member connecting the arms above the front side of the tub when the arms are in the bathseat position, the second cross member connecting the arms behind the rear side of the tub in both the bathtub and bathseat positions, the support including a pair of feet disposed behind the rear side of the tub and adapted to be mounted to a smooth surface; and a leg depending from the first cross member and configured to be slidably received by the hole in the tub, the leg including a foot displaced from the first cross member and adapted to be mounted to the smooth surface;

wherein feet of the support and the foot of the leg are adapted to be received by a kitchen sink.

11. An infant bathseat comprising:

a tub having a bottom surface and raised side, head and foot portions defining a volume for containing water when said tub is in a reclining position with said head and foot portions positioned above said bottom surface;

an arm on each side of said tub extending toward said foot portion and extending below said tub adjacent said side portions, each arm being pivotally connected to said tub between said foot and said head portions, whereby on rotation of said arms away from said tub, said tub is raised from a reclining to a seating position with said head portion elevated above said foot portion;

a cross member connecting said arms near said foot portion; and a support member extending vertically downward from said cross member and with said tub in a seating position forming a passive restraint for a child when seated in the bathseat.

12. The bathseat of claim 11 wherein said cross member is disposed above said foot portion when said tub is in the seating position.

13. The bathseat of claim 11 wherein the arm is fixedly attached to a shaft having a generally dumbbell shape, and wherein the tub includes a hub defining a slot in communication with a circular hole, the hole being adapted to rotatably receive the shaft, the slot being adapted to slidably receive the shaft when the length of the dumbbell shape is directed along the length of the shaft.

14. The bathseat of claim 11 wherein the arms and the cross member are integrally connected.

15. An apparatus comprising:

a tub defining a volume for receiving a child and holding water in a top side when oriented in a reclined position, the tub having a back side, a head end, and a foot end;

a first arm and a second arm connected by a cross member and attached to the tub, the arms adapted to pivot about an axis displaced from the foot end of the tub into at least first and second positions, with the cross member disposed above, and displaced from, the top side of the tub when the arms are in their first position; and an crotch restraint member attached to and extending from the cross member, the elongated member extending toward the foot end of the tub to provide a passive crotch restraint for a child received by the tub when the arms are in their first position.

16. The apparatus of claim 15 wherein the crotch restraint member has a foot disposed below the foot end of the tub when the arms are in their second position, the foot adapted to engage a smooth support surface.

17. The apparatus of claim 15 wherein the crotch restraint member includes a base, a lever attached to the base, and a portion biased away from the base.

18. The apparatus of claim 17 wherein the lever is disposed at least partially above a top surface of the tub when the arms are in their first position, the crotch restraint member being adapted to interfere with the top surface of the tub to inhibit rotation of the arms from their first position toward their second position.

19. The apparatus of claim 17 wherein the crotch restraint member and the tub are adapted to inhibit movement of the lever toward the base when the arms are in their first position.

20. The apparatus of claim 17 wherein the crotch restraint member and the tub are adapted to allow movement of the lever toward the base when the arms are disposed in a third position further from the second position than the first position.

21. The apparatus of claim 15 wherein at least one of the arms is fixedly attached to a shaft having a cross section of a generally rectangular shape with generally curved opposing ends.

22. The apparatus of claim 21 wherein the tub provides a key hole having a slot in fluid communication with a circular hole disposed at an end of the slot, the slot having a width smaller than a diameter of the circular hole and larger than a width of the rectangular portion of the shaft, a length of the cross section of the shaft from one generally curved end to the other being larger than the width of the slot and smaller than the diameter of the circular hole.

23. The apparatus of claim 22 wherein the generally curved ends have a curvature corresponding to a diameter approximately equal to the diameter of the circular hole.

24. The apparatus of claim 22 wherein the shaft is attached to said at least one arm such that the shaft is disposed within the circular hole and the length of the rectangular section is disposed obliquely to a length of the slot when the arms are in the first and second positions.

25. The apparatus of claim 21 wherein said at least one arm is integrally attached to the shaft.

26. An apparatus adapted to receive a child and to be pivoted between a bathtub position and a bathseat position, the apparatus comprising:

a tub having a front side and a rear side, the front side defining a volume for receiving a child and holding water, the tub further having a head end and a foot end;

a support including a pair of arms and a cross member, each arm being pivotally coupled to the tub for movement into a bathtub position and into a bathseat position, the cross member connecting the arms above the front side of the tub when the arms are in the bathseat position, the arms extending rearward from the tub in both the bathtub and bathseat positions, the support including a pair of feet disposed rearward of the tub and adapted to be mounted to a smooth surface; and a leg depending from the cross member and including a foot displaced from the cross member and adapted to be mounted to the smooth surface;

wherein feet of the support and the foot of the leg are adapted to be received by a kitchen sink.

* * * * *